United States Patent [19]

Oshikubo

[11] Patent Number: 4,591,072

[45] Date of Patent: May 27, 1986

[54] REPEATING DISPENSER

[75] Inventor: Yuji Oshikubo, Sakura, Japan

[73] Assignee: Nichiryo Co., Ltd., Tokyo

[21] Appl. No.: 716,038

[22] Filed: Mar. 26, 1985

[30] Foreign Application Priority Data

Mar. 27, 1984 [JP] Japan ..... 59-58891

[51] Int. Cl.[4] ..... B67D 5/22

[52] U.S. Cl. ..... 222/44; 222/287; 222/309; 222/391; 73/864.18

[58] Field of Search ..... 73/864.16, 864.17, 864.18; 222/41, 43, 44, 46, 47, 287, 288, 309, 391

[56] References Cited

U.S. PATENT DOCUMENTS

| | | | |
|---|---|---|---|
| 3,161,323 | 12/1964 | Bent | 222/41 |
| 4,022,207 | 5/1977 | Citrin | 222/391 X |
| 4,084,730 | 4/1978 | Franke et al. | 222/309 |
| 4,099,548 | 7/1978 | Sturm et al. | 222/391 X |
| 4,316,558 | 2/1982 | Kubiak | 222/327 X |
| 4,335,621 | 6/1982 | Tervamäki et al. | 73/864.16 X |
| 4,406,170 | 9/1983 | Kühn | 73/864.16 |
| 4,415,101 | 11/1983 | Shapiro et al. | 222/288 |
| 4,467,942 | 8/1984 | Oshikubo | 222/44 |

*Primary Examiner*—Joseph J. Rolla
*Assistant Examiner*—Jay I. Alexander
*Attorney, Agent, or Firm*—James E. Nilles

[57] ABSTRACT

A repeating dispenser for dispensing uniform quantities of liquid includes an actuator rotatably connected to an actuating button. The actuator is biased upward by a spring towards a downwardly facing abutment in the non-actuated condition of the dispenser and is connected through a vertically displaceable rack shaft to a slide which releaseably mounts a cylinder piston device comprising a plurality of identical pistons and cylinders. An operating rod connects the slide to a suction button which is slideable along the outside surface of the dispenser. A pawl cooperates with the rack shaft and is kept from engagement with the rack shaft in the non-actuated condition of the dispenser. The actuating button includes a series of step-like stop portions engageable with an upwardly facing abutment to allow the repeated dispensing of uniform quantities of liquid.

3 Claims, 11 Drawing Figures

REPEATING DISPENSER

BACKGROUND OF THE INVENTION

This invention relates generally to dispensing devices and, particularly to repeating dispensers.

Repeating dispensers have been advantageously utilized in chromatographic work, chemical analysis or tests and the like, but it is to be understood that the utility is not confined thereto. Repeating dispensers are utilized to provide, with one filling operation that sucks in a relatively large amount of fluid, repetitive, accurate discharges of exactly the same minute quantities of fluid.

U.S. Pat. No. 3,161,323 shows a repeating dispenser of the type aforementioned, and the construction thereof is simple; however, the dispenser has an index rod having rack teeth thereon and which is exposed to the outside, thus, it is difficult to handle the dispenser.

German patent disclosure No. P 2736551 discloses a generally tubular repeating dispenser having an actuating button on the top end. The dispenser is very easy to handle; however, there is a shortcoming that the relatively large amount of the liquid sucked and stored in the dispenser can only be dispensed by repeatedly depressing the actuating button, and that it is not easy to disassemble a cylinder and a piston from the dispenser which would be required in changing the liquid being sucked in and dispensed.

German patent disclosure No. 2926691 shows another repeating dispenser generally solving the problems aforementioned; however, there are many levers projecting sidewise from a generally tubular main body thus it is objectionable in the handling operation of the piston device.

The inventor has shown in U.S. Pat. No. 4,467,942 a repeating dispenser comprising a tubular main body, an actuating member slidably disposed in the main body with the upper end thereof projecting out of the upper end of the main body and having a pressure button thereon, a spring for biasing upwards the actuating member, a spring retainer slidably disposed in the main body and normally abutting the lower end of the actuating member to transmit the biasing force of the spring to the actuating member, a stop provided on the inner surface of the main body for abutting engagement by the spring retainer in the non-actuated condition of the dispenser, a pawl pivotally connected to the spring retainer, a pawl spring for biasing the pawl in the radially outward direction, a rack shaft slidably provided on a side surface of the main body and having a plurality of rack teeth thereon for engaging with said pawl, means for preventing the pawl from engaging with the rack shaft when the spring retainer abuts against the stop, a suction button connected to the rack shaft and slidable along a longitudinal recess in the main body, and a cylinder piston device with the cylinder thereof being connected to the main body and the piston thereof being connected to the lower end of the rack shaft.

The dispenser operates generally satisfactorily, however, it is required in chemical or pharmaceutical tests or analysis to dispense predetermined same quantities of liquid to a plurality of discrete locations simultaneously so as to perform a multiple member of tests efficiently.

SUMMARY OF THE INVENTION

This invention aims to satisfy aforesaid requirements and, a repeating dispenser for repeatedly dispensing uniform quantities of liquid according to the invention comprises: a tubular body consisting of integrally connected upper and lower body, said upper body having a bottom wall and said lower body having attachment means at its bottom ends for releasably securing a cylinder piston device mounting thereon a plural sets of cylinder and pistons, said lower body having a generally rectangular cross section; radially inwardly projecting means mounted near to the top end of the upper body and defining an upwardly facing abutment and a downwardly facing abutment; an actuating button projecting upwards above the top end of the upper body and having at its bottom a plurality of circumferentially spaced axially stepped surfaces for selectively engaging against said upwardly facing abutment to define one of a plurality of different distances through which said button can be moved downward from its normal position; an actuator non-rotatably and slidably received in the upper body and connected rotatably to said button, said actuator having an upwardly facing shoulder for engaging with said downwardly facing abutment; a spring acting between the actuator and the bottom wall of the upper body for biasing upward the actuator; a slide slidably received in the lower body and having means for releasably securing thereto pistons of said cylinder piston device; a rack shaft secured to the slide to extend upward therefrom and having a plurality of rack teeth spaced along its length; a pawl pivoted on said actuator and extending through an opening in said bottom wall of the upper body, said pawl being swingingly biased toward engagement with said rack teeth, said opening defines means preventing the pawl from engagement with said rack teeth in the normal position of the actuator; an operating rod secured to the slide and extending upward therefrom through the bottom wall of the upper body and along one side surface of the upper body; and an operating button secured to the upper end of the operating rod.

The rack teeth of the rack shaft do not engage with the pawl in the non-actuated condition, thus it is possible to refill or replenish the dispenser at any desired time and, further, the position of the operating button generally indicates the amount of fluid remaining in the cylinder piston device.

BRIEF DESCRIPTION OF THE DRAWINGS

Further objects and advantages of the invention will become apparent from the following detailed description in conjunction with the drawings exemplifying a preferred embodiment of the invention, in which.

DETAILED DESCRIPTION OF THE PREFERRED EMBODIMENT

Figure 5:
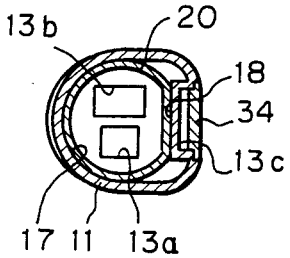
FIG. 5 is a sectional view taken along line V—V in FIG. 1.
Figure 6:
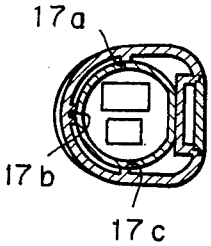
FIG. 6 is a modified form of FIG. 5.

The repeating dispenser shown in the drawings comprises a generally tubular main body 10 consisting of a generally tubular upper body 11 and a lower body 12 secured to the upper body and having a generally rectangular cross section. The upper body has a bottom wall 13 having generally rectangular three openings as shown in FIG. 5. The upper body 11 further has on one side of the uppermost portion thereof a sidewise projecting portion 14 for serving as a finger hold, a rough surface portion 15 on the same side for serving as a slip preventing surface, and a vertically extending recess 16 defining a generally planer surface 16*a* preferably in the side opposite to the finger hold 14 of the upper body 11. The surface 16*a* is coextensive to radially inner side surface of the opening 13*c*, as shown in FIG. 5. There are provided on the inner surface of the upper body 11 a generally semicircular guide surface 17 and a flat guide surface 18 as shown in FIG. 5. In a modified form shown in FIG. 6 the guide surface 17 in FIG. 5 is divided into a plurality of guide surface portions 17*a*, 17*b* and 17*c*. An abutment member 19 is secured to the uppermost portion of the upper body 11 and extends downward along one side of the inner surface of the upper body 11 and, an upwardly facing abutment 19*a* and a downwardly facing abutment 19*b* is formed on a radially inwardly projecting portion of the abutment member 19.

Figure 1:
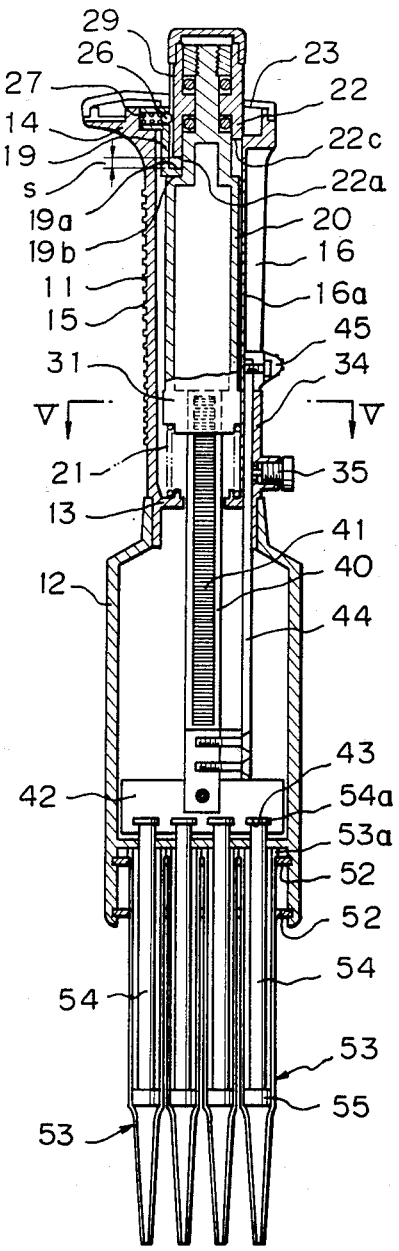
FIG. 1 is a longitudinal sectional view taken along line I—I in FIG. 3 of a repeating dispenser according to the invention.
Figure 3:
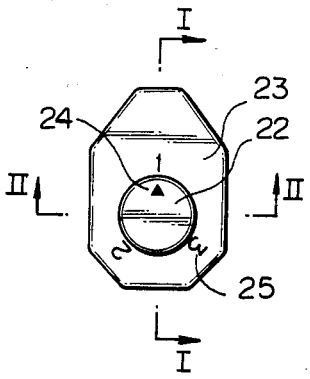
FIG. 3 is a top view of the dispenser of FIG. 1.
Figure 4:
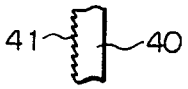
FIG. 4 is a partial enlarged view of a rack shaft in the dispenser of FIG. 1.

An actuator or actuating member 20 is slidably and non-rotatably provided in the upper body 11, and a spring 21 extends between the actuating member 20 and the bottom wall 13 of the upper body 11 to bias the actuating member 20 against the downwardly facing abutment 19*b*. An actuating button 22 is rotatably connected to the upper end of the actuating member 20, but the relative axial or vertical displacement therebetween is prevented. In the embodiment, two axially spaced ball bearings are provided between the actuating member 20 and the actuating button 22. But the ball bearings may be substituted by any desired publicly known mechanisms. The actuating button 22 has on the lowermost portion a plurality of circumferentially spaced stepped surfaces 22*a*–22*c* for cooperating with the upwardly facing abutment 19*a* of the abutment member 19. In the embodiment, the lower end surface of the actuating button is divided into three portions 22*a*–22*c* and a clearance s between the abutment 19*a* and the surface 22*a* at the condition shown in FIG. 3 and FIG. 1 is the minimum, and when the actuating button 22 is rotated by 120 degrees in the counterclockwise direction, the clearance s increases to a medium and, when the actuating button is further rotated by 120 degrees in the same direction the clearance increases to the maximum. The clearance s between the actuating button 22 and the upwardly facing abutment 19*a* in the non-actuated condition defines a possible downward stroke of the actuating button 22 or of the actuating member 20.

For indicating the angular position of the actuating button 22 with respect to the actuating member 20 or of the abutment member 19, there are provided respectively on the uppermost portion of the actuating button 22 and on a cap 23 which closes the upper end of the upper body 11 and through which the actuating button 22 rotatably and slidably passes, a reference mark 24 and scale or reference numerals 25 as shown in FIG. 3. Further, there are provided a ball 26 and a biasing spring 27 in the abutment member 19, and the ball 26 engages with any one of recesses 29 which are provided in the outer circumference of the actuating button 22 for clickingly locating the angular position of the actuating button.

Figure 2:
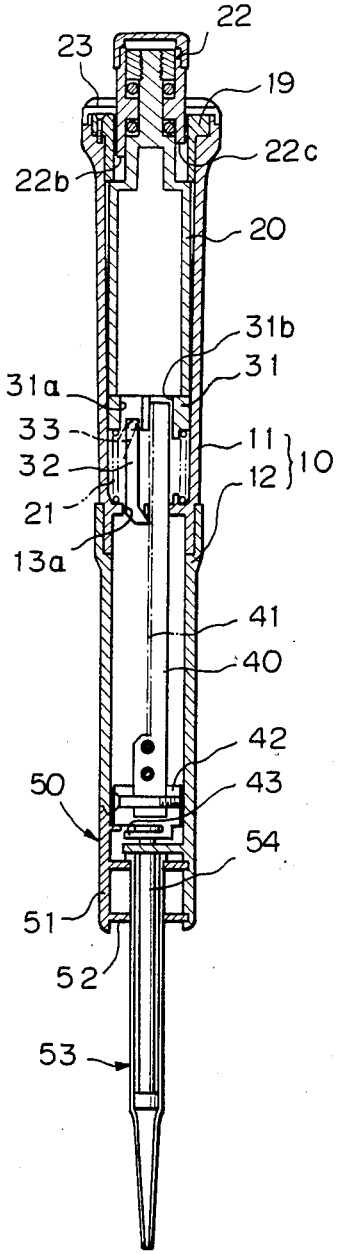
FIG. 2 is a longitudinal sectional view of the dispenser of FIG. 1, taken along line II—II in FIG. 3.

The actuating member 20 has integrally a disc-shaped portion 31 on the lower end thereof, and the disc-shaped portion 31 has vertically openings 31*a* and 31*b* generally corresponding to and aligning with openings 13*a* and 13*b* in the bottom wall 13 respectively. A pawl 32 is pivotally mounted on the disc-shaped portion 31 and extends downward therefrom as shown in FIG. 2. A spring 33 acts on the pawl 32 to bias it in the counterclockwise direction as viewed in FIG. 2.

The pawl 32 cooperates with rack teeth 41 on a rack shaft 40 which is connected to a slide 42 and extends vertically upward therefrom. The slide 42 is slidably disposed in the lower body 12. The rack shaft 40 extends through openings 13*b* and 31*b* in the bottom wall 13 and the disc-shaped portion 31. In the non-actuated condition of the actuating member 20 as shown in FIG. 1, one side edge of the opening 13*a* in the bottom wall 13 engages with an inclined surface portion of the pawl 32 so that a pawl claw of the pawl 32 is spaced from rack teeth 41 of the rack shaft 40.

An operating rod 44 is also rigidly secured to the slide 42 and extends vertically upward parallel to and spaced from the rack shaft 40. The rod 44 extends through the opening 13*c* and along the surface 16*a* of the vertically extending recess 16 in the upper body 11, and an operating button 45 is connected to the upper end of the rod 44. In the embodiment, the lower end portion of the recess 16 is covered by a cover member 34 which is integrally connected to the upper body 11 and cooperates therewith to define the opening 13*c* at the location of the bottom wall 13.

An adjusting screw 35 is mounted on the cover member 34 of the upper body 11 for applying adjustable spring force on the operating rod 44 in the leftward direction as viewed in FIG. 1. The adjusting screw 35 controls the operating speed of the rack shaft 40.

A cylinder piston device 50 is detachably mounted on the lower end portion of the lower body 12. The cylinder piston device 50 includes, in the embodiment shown in FIGS. 1, 2 and 7, a mount 51 and four sets of cylinder pistons 53 mounted detachably on the mount 51. Each piston 54 of each cylinder piston has on the upper end a flange 54*a* which is detachably received in corresponding recess 43 in the slide 42, and each cylinder of the cylinder piston 53 is detachably mounted on the mount 51. The mount 51 has horizontally extending and vertically spaces ridges 52 and 52 which are slidably received in horizontally extending and vertically spaced grooves 12*a* and 12*a* formed in the lower body 12 in connecting the cylinder piston device with the lower body 12. Each piston 54 has on its lower end a piston portion 55 for sealingly engaging with cylindrical inner surface of cylinder portion of each cylinder piston 53. In the embodiment shown in FIGS. 1 and 2, a tapered portion is formed in the lower end portion of each cylinder piston 53 so that liquid dispensing operation can be performed easily.

In operation, the distal ends of respective cylinder piston 53 of the cylinder piston device 50 are immersed into a reagent bottle or the like, and the operating button 45 is moved upwards along the recess 16. The reagent is sucked into the cylinders of the cylinder piston device 50. The pawl 32 is normally separated from the rack teeth 41 of the rack shaft 40, and thus the operating button 45 can freely be pushed upwards or downwards. By repeating upward and downward movement of the operating button 45, it is easy to expel air from the cylinders 53 of the cylinder piston device 50.

After sucking a predetermined amount of liquid into the cylinders (usually, the sucking is performed until the operating button 45 takes the uppermost position in the recess 16), the dispenser is displaced onto test tubes or the like and the actuating button 22 is depressed downward. The actuating member 20 moves downward against the biasing force of the spring 21. The pawl 32 supported on the disc-like portion 31 of the actuating member 20 moves downward relative to the bottom wall 13 so that the inclined surface portion of the pawl 32 separates from the edge of the opening 13*a* and the pawl 32 rotates in the counterclockwise direction as viewed in FIG. 2. The pawl claw of the pawl 32 engages with a rack tooth of the rack shaft 40 and drives downward the rack shaft 40. The downward movement of the actuating member 20 terminates when one of the steps 22*a*–22*c* on the lower end of the actuating button 22 engages with the abutment 19*a*. A predetermined amount of liquid which is determined by the downward stroke of the actuating member 20 is dispensed from each cylinder of the cylinder piston device 50.

By releasing the depressing force applied on the actuating button 22, the actuating button 22, the actuating member 20, and the pawl 32 return to the initial position shown in FIGS. 1 and 2 due to the biasing force of the spring 21; however, the rack shaft 40, the slide 42, the operating rod 44, the operating button 45 and the pistons 54 of the cylinder piston device 50 maintain the downwardly displaced position. By repeating the depressing and releasing, the predetermined same amount of liquid is repeatedly dispensed from each cylinder of the cylinder piston device 50 simultaneously until the rack shaft 40, the slide 42 and the pistons of the cylinder piston device 50 are displaced to the lowermost position.

It will be noted that the non-actuated or released position of the actuating member 20 as shown in FIGS. 1 and 2 is defined by a shoulder of the actuating member 20 engaging with the downwardly facing abutment 19*b* as shown in FIG. 1.

The cylinder piston device 50 can easily be demounted from lower body 12 by displacing it leftward in FIG. 2. Each cylinder piston 53 of the cylinder piston device can easily be demounted from the mount 51 of the cylinder piston device 50 by displacing it rightward in FIG. 2. Therefore, the cylinder pistons 53 may be of a disposable type, and the capacity or the dispensing amount for a given stroke may be changed as desired.

The amount of the liquid being dispensed on each actuation is determined by the distance s between the upper surface 19*a* of the projection 19 and whichever are of the steps 22*a*–22*c* is aligned with the projection 19, and the amount can easily be changed by rotating clickingly the actuating button 22.

The adjusting screw 35 can effectively control the moving speed of the slide 42, thus, it is possible to prevent the liquid being dispensed from ejecting or spouting from the distal ends of the cylinder piston device 50.

Figures 8, 9, 10, 11:
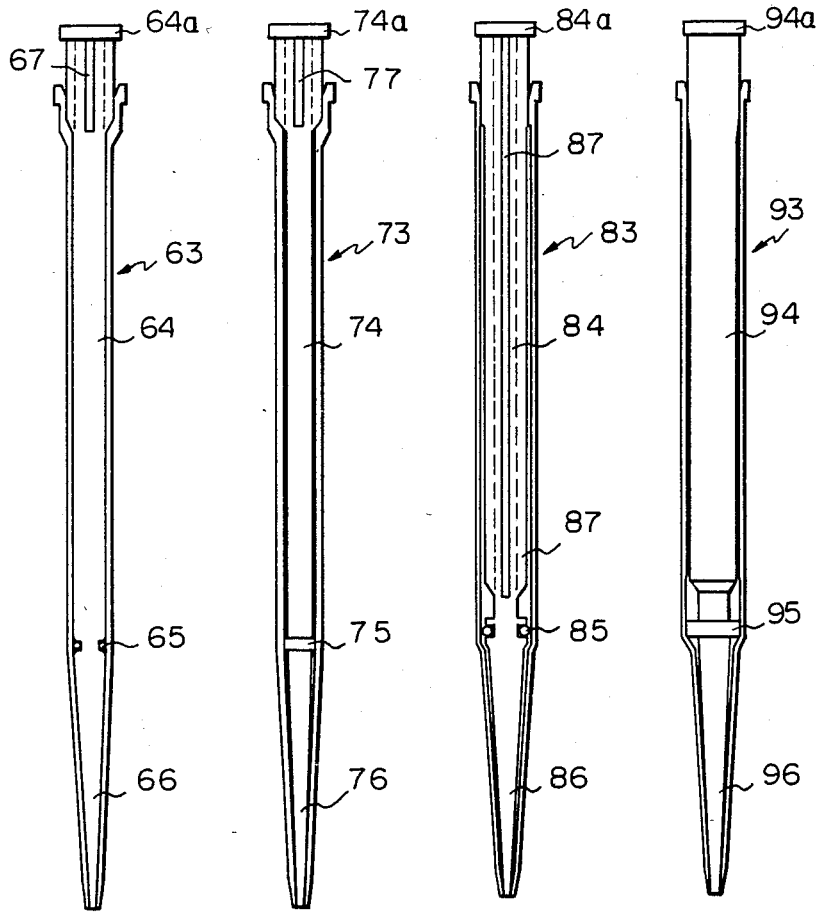
FIGS. 8–11 are views showing various forms of cylinder and piston in the cylinder piston device according to the invention.

FIGS. 8–11 show modified forms of cylinder piston. In FIG. 8, the cylinder piston 63 comprises a piston 64 which has a flange 64*a* on the upper end, four angular spaced and vertically extending guide ribs 67 on the upper end portion, an O-ring seal 65 and a tapered portion 66 on the lower end portion. A tip (not shown) may be connected to the lower end of the cylinder piston 63 for sucking liquid therein in upward or sucking stroke of the dispenser.

FIG. 9 is generally similar to the embodiment of FIG. 8, but, the O-ring seal 65 in the embodiment of FIG. 8 is substituted by a piston portion 75 slidably engaging with cylinder portion. The embodiment of FIG. 9 also includes cylinder piston 73, piston 74, flange 74*a*, ribs 77, and tapered portion 76.

FIG. 10 shows a further modified form of a cylinder piston. In the embodiment, guide ribs 67 in the embodiment of FIG. 8 is modified to extend along substantial length in the cylinder portion of cylinder device 83. An O-ring 85 engages with the cylinder portion of the cylinder piston. The embodiment of FIG. 10 also includes piston 84, flange 84*a*, ribs 87, and tapered portion 86.

FIG. 11 shows another embodiment of the cylinder piston, which is generally similar to the embodiment of FIG. 10 and likewise includes cylinder piston 93, piston 94, flange 94*a*, piston portion 95, and tapered portion 96.

Figure 7:
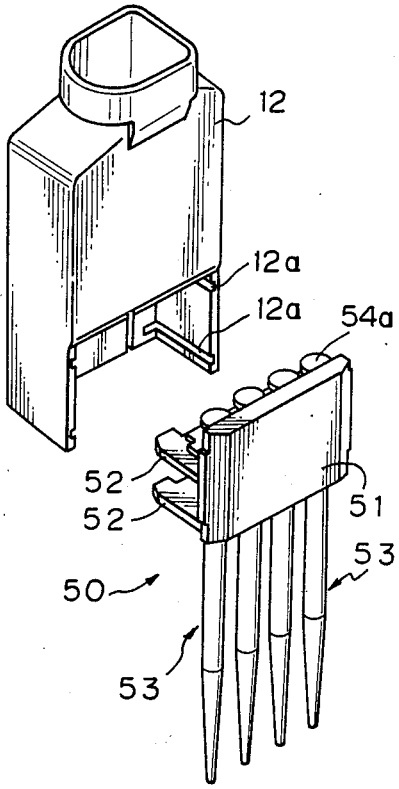
FIG. 7 is a perspective view of a cylinder piston device and a lower body of the dispenser of FIG. 1.

The diameter of cylinder portion of FIGS. 8 and 9 is small as compared with FIGS. 7, 10 and 11, thus, the amount of liquid dispensed from the dispenser in response to a given amount of downward stroke of the guide 42 is small as compared with the latter.

In a preferred embodiment, the pitch of the rack teeth is 0.9 mm, the number of the rack teeth is 51, and by rotating the actuating button it is possible to control the stroke of the dispenser to correspond to one, two and four pitches of the rack teeth. Two types of cylinder pistons are prepared with each of small diameter cylinder pistons being able to dispense 0.01, 0.02 and 0.04 ml each time, and each large diameter cylinder piston can dispense 0.025, 0.05 and 0.1 ml each time.

According to the invention, the actuating button is provided on the top end of the main body, thus, it is easy to depress the actuating button by a finger. The operating button 45 can be operated easily either in sucking the liquid or in discharging the liquid. Further, the cylinder piston device can be exchanged quickly and easily, and the amount of liquid being dispensed can be adjustably varied through a wide range. Further, the adjusting screw can effectively control discharging or dispensing speed which is effective to accurately dispense a predetermined amount of liquid. Further, a plurality of cylinder pistons are exchangeably mounted on the dispenser, thus, it is possible to dispense liquid onto a large number of objects thereby minimizing the labor and time of chemical tests or analysis.

What is claimed is:

1. A dispenser for repeatedly dispensing uniform quantities of liquid comprising:

a tubular body consisting of integrally connected upper and lower body, said upper body having a bottom wall and said lower body having attachment means at its bottom end for releasably securing a cylinder piston device mounting thereon a plural sets of cylinder and pistons, said lower body having a generally rectangular cross section;

radially inwardly projecting means mounted near to the top end of the upper body and defining an upwardly facing abutment and a downwardly facing abutment;

an actuating button projecting upwards above the top end of the upper body and having at its bottom a plurality of circumferentially spaced axially stepped surfaces for selectively engaging against said upwardly facing abutment to define one of a plurality of different distances through which said button can be moved downward from its normal position;

an actuator non-rotatably and slidably received in the upper body and connected rotatably to said button, said actuator having an upwardly facing shoulder for engaging with said downwardly facing abutment;

a spring acting between the actuator and the bottom wall of the upper body for biasing upward the actuator;

a slide slidably received in the lower body and having means for releasably securing thereto pistons of said cylinder piston device;

a rack shaft secured to the slide to extend upward therefrom and having a plurality of rack teeth spaced along its length;

a pawl pivoted on said actuator and extending through an opening in said bottom wall of the upper body, said pawl being swingingly biased toward engagement with said rack teeth, said opening defines means preventing the pawl from engagement with said rack teeth in the normal position of the actuator;

an operating rod secured to the slide and extending upward therefrom through the bottom wall of the upper body and along one side surface of the upper body; and an operating button secured to the upper end of the operating rod.

2. The dispenser of claim 1, further characterized by cooperating click stop means provided between said actuating button and said actuator for defining positions of rotational adjustment said actuating button.

3. The dispenser of claim 1, further characterized by an adjusting screw provided on the main body for biasing the operating rod in the transverse direction thereby controlling the actuating speed of the dispenser.

* * * * *